United States Patent [19]

Graebe

[11] Patent Number: 4,713,854

[45] Date of Patent: Dec. 22, 1987

[54] CONSTANT FORCE CUSHION

[76] Inventor: Robert H. Graebe, 4 Signal Hill Blvd., Belleville, Ill. 62223

[21] Appl. No.: 717,329

[22] Filed: Mar. 29, 1985

Related U.S. Application Data

[63] Continuation-in-part of Ser. No. 451,445, Dec. 20, 1982, abandoned.

[30] Foreign Application Priority Data

Dec. 19, 1983 [WO] PCT Int'l Appl. ..... PCT/US83/01983

[51] Int. Cl.[4] ..... A47C 27/16

[52] U.S. Cl. ..... 5/481; 5/448; 297/DIG. 1

[58] Field of Search ..... 5/481, 468, 469, 461, 5/431, 448, 420, 417; 297/DIG. 1

[56] References Cited

U.S. PATENT DOCUMENTS

| | | | |
|---|---|---|---|
| 3,047,282 | 7/1962 | Hardy | 5/481 |
| 3,258,791 | 7/1966 | Kaplan | 5/481 |
| 3,681,797 | 8/1972 | Messner | 5/469 |
| 3,940,811 | 3/1976 | Tomikawa et al. | 5/481 |
| 3,974,532 | 8/1976 | Ecchuya | 5/481 |
| 4,005,236 | 1/1977 | Graebe | 5/456 |
| 4,064,578 | 12/1977 | Yamada | 5/481 |
| 4,106,139 | 8/1978 | Southard | 5/481 |
| 4,276,666 | 7/1981 | Yamada | 5/481 |
| 4,399,574 | 8/1983 | Shuman | 5/417 |
| 4,541,136 | 9/1985 | Graebe | 5/456 |

FOREIGN PATENT DOCUMENTS

| | | | |
|---|---|---|---|
| 1727445 | 3/1956 | Fed. Rep. of Germany | 5/481 |
| 3023287 | 1/1982 | Fed. Rep. of Germany | 5/481 |
| 1372493 | 8/1964 | France | 5/481 |
| 542980 | 5/1956 | Italy | 5/481 |
| 921098 | 3/1963 | United Kingdom | 5/481 |

*Primary Examiner*—Gary L. Smith
*Assistant Examiner*—Vinh Luong
*Attorney, Agent, or Firm*—Gravely, Lieder & Woodruff

[57] ABSTRACT

A cushion is composed of strips formed from resilient foam material, and these strips provide a displaceable surface which, when deformed, exerts a restoring force that is generally constant irrespective of the extent of the deformation. Thus, the cushion will apply a generally uniform supporting pressure against an irregularly contoured body that is supported on it. Each strip is composed of a succession of arch-like segments. Moreover, the strips are arranged side-by-side with the arch-like segments of any strip being offset from the arch-like segments of the strips adjacent to it.

20 Claims, 15 Drawing Figures

FIG. 6
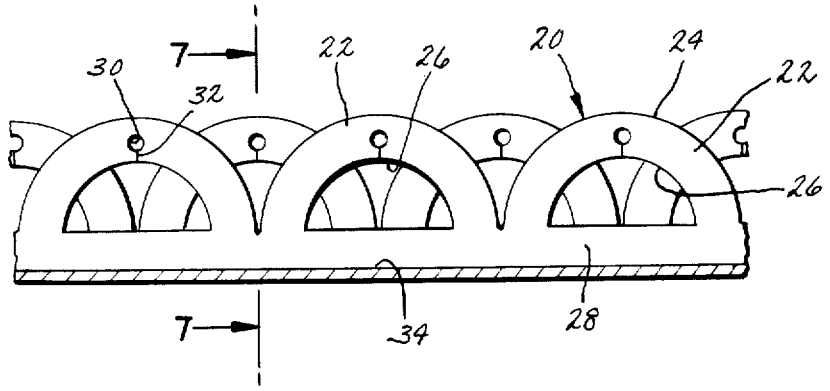
FIG. 7
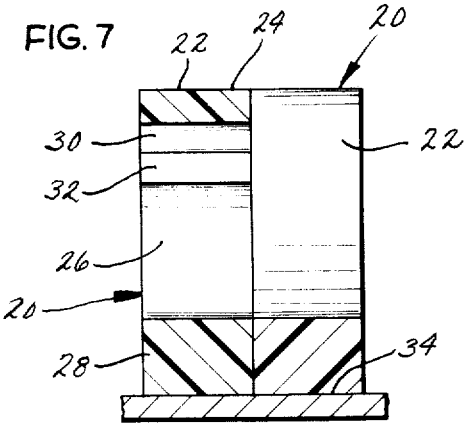
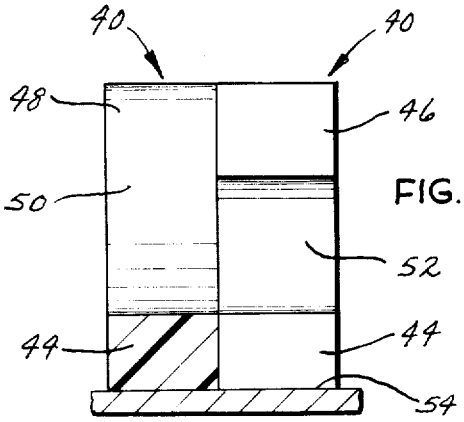
FIG. 9
FIG. 8
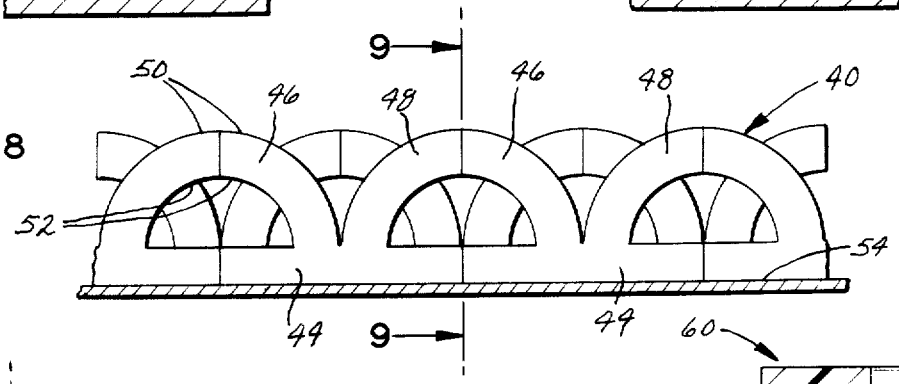
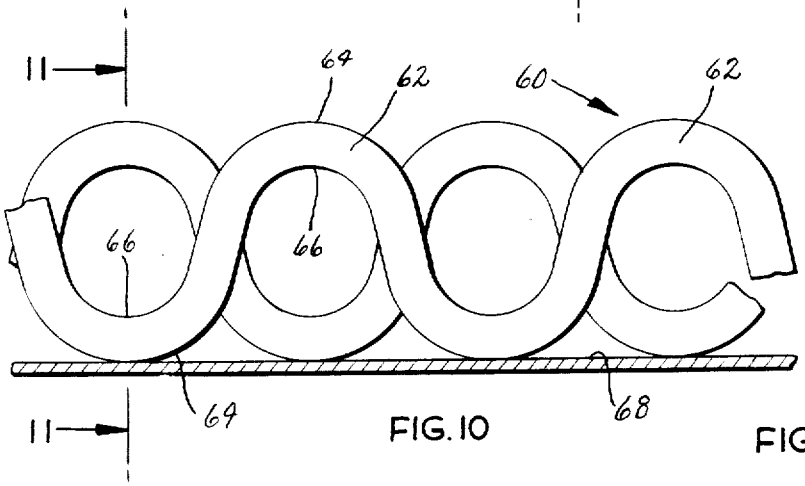
FIG. 10
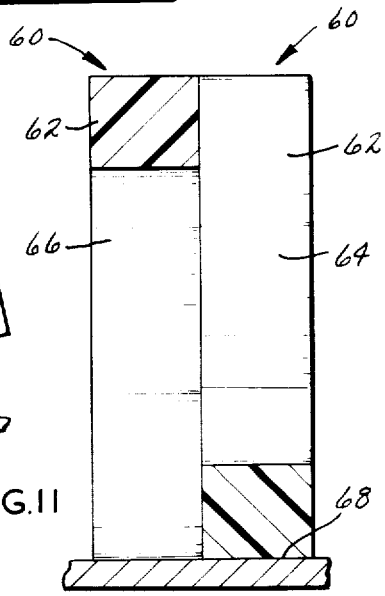
FIG. 11

FIG. 12
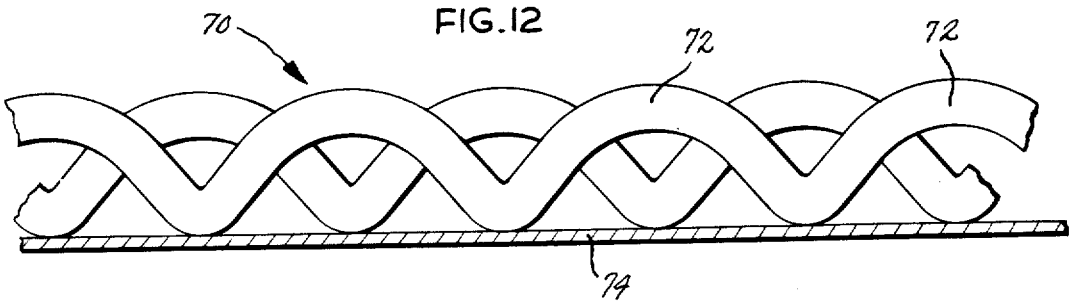
FIG. 13
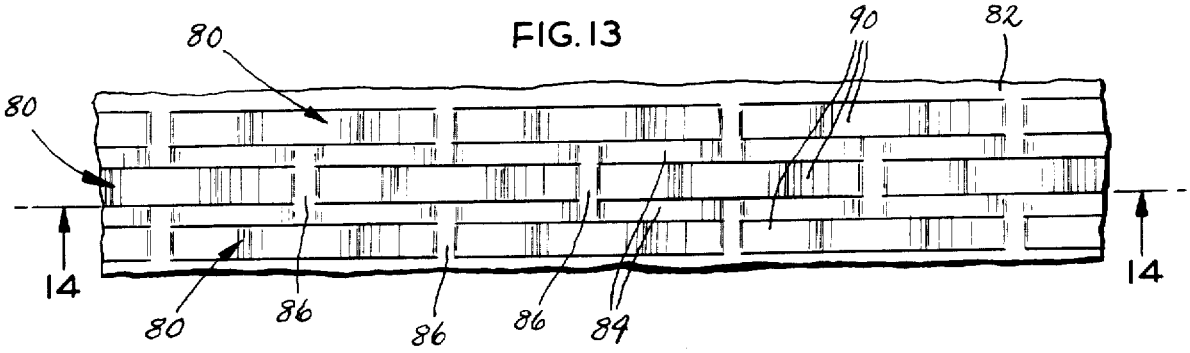
FIG. 14
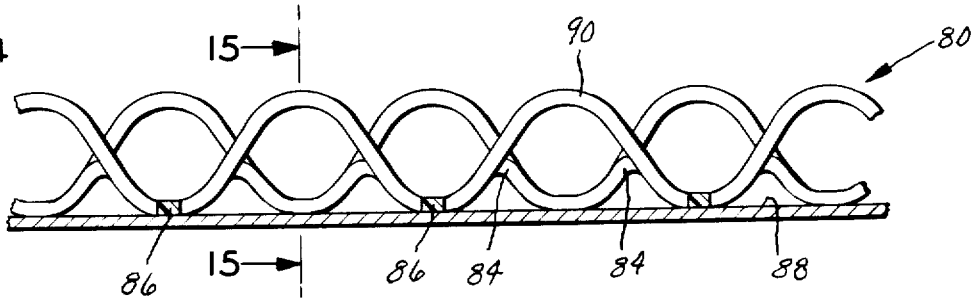
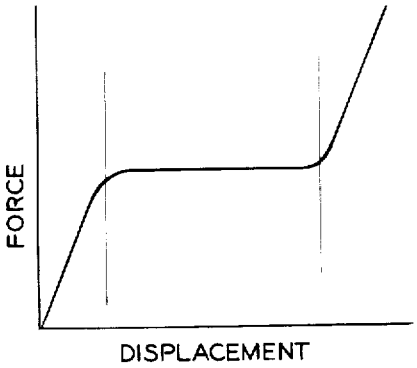
FIG. 5
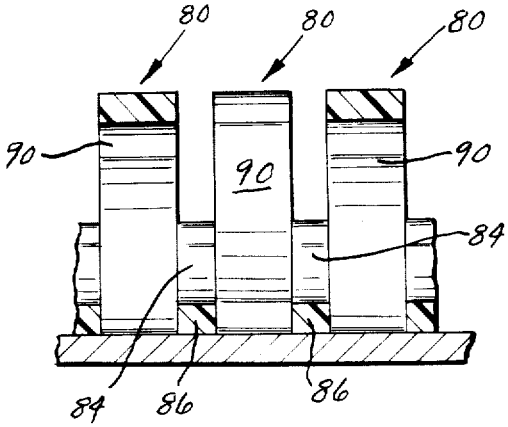
FIG. 15

CONSTANT FORCE CUSHION

BACKGROUND OF THE INVENTION

This invention relates in general to cushions and more particularly to cushions formed from a resilient material such as a foamed polymer.

The typical cushion used for supporting the body in a prone position or a seated position, such as a mattress, a seat cushion, or a padded back rest, acts much like a conventional coil spring in that the restoring force exerted against a body which deforms it is generally proportional to the extent of the deformation. Thus, in the case of a mattress, the hip region might protrude further into the mattress than the adjoining waist or thigh regions, and as a consequence the supporting pressure exerted by the mattress would be greater at the hip than at the thigh or the waist. From both the standpoint of comfort and health it is not desirable to concentrate the supporting force at any particular region of the body.

With individuals who are confined to bed for extended periods of time it is most important to avoid prolonged concentration of the supporting force on particular regions of the body. Indeed, any skin area to which sustained pressure is applied experiences a reduction in the flow of blood and as a consequence this particular skin area does not receive sufficient oxygen or nutrients. Decubities ulcers may develop as a result of these deficiencies, and these ulcers can be quite uncomfortable as well as life-threatening. Individuals who have become immobile or sensitive to touch require a cushion that does not interfere with blood flow at sensitive skin areas. Suspension forces that are distributed in a hydrostatic-like manner cause the least interference with blood flow and are least likely to produce cell neurosis.

Individuals who are immobile often have difficient lymph systems, and it is one's lymph system that controls the onset or extent of edema, which in itself is a debilitating condition. However, edema may be minimized at the contact site on the skin area and its debilitating effects likewise minimized by the application of a hydrostatic-like counter pressure to the body.

Thus, it is desirable to have a body supporting cushion, whether it be in the form of a mattress, a seat cushion, or a back rest, which applies a generally uniform supporting pressure, that is a hydrostatic-like counter pressure, over the skin area in contact with it. Heretofore, cushions have been developed which approach this end, but these cushions rely on entrapped fluids, such as air or water, and are therefore complicated in construction and expensive to manufacture. Moreover, these cushions, for the most part, do not allow air to circulate around the supported area, and the absence of air is also harmful to the skin.

Conventional cushions of the type formed from resilient foam materials, such as expanded polyurethane, on the other hand, are simple and inexpensive to manufacture, but they do not exert uniform supporting pressure on the supported region of the body. Instead, they behave much in the same manner as a conventional spring mattress.

SUMMARY OF THE INVENTION

One of the principal objects of the present invention is to provide a cushion which may utilize a conventional resilient foam material for its cushioning properties, yet exerts on the supported object a pressure that is generally uniform over the entire area of the object that is in contact with it. Another object is to provide a cushion of the type stated that is simple in construction and easy and inexpensive to manufacture. A further object is to provide a cushion of the type stated that permits air to circulate in that region of a supported body that is in contact with the cushion. It is an additional object to provide a cushion of the type stated that enables fluids to drain away from a body supported on the cushion. Still another object is to provide a cushion of the type stated that can be easily disassembled for cleaning. These and other objects and advantages will become apparent hereinafter.

DESCRIPTION OF THE DRAWINGS

In the accompanying drawings which form part of the specification and wherein like numerals and letters refer to like parts wherever they occur

FIG. 5 is a graph illustrating the idealized constant force characteristics of the individual arch-like elements that comprise the cushion of the present invention;

FIG. 6 is a side elevational view of the cushion formed with modified strips of arch-like segments;

FIG. 7 is a sectional view taken along line 7—7 of FIG. 6;

FIG. 8 is a side elevational view of the cushion formed with other modified strips of arch-like segments, with each strip being in turn formed from a succession of individual sections;

FIG. 9 is a sectional view taken alone line 9—9 of FIG. 8;

FIG. 10 is a side elevational view of the cushion formed with still different modified strips having arch-like segments;

FIG. 11 is a sectional view taken along line 11—11 of FIG. 10;

FIG. 12 is a side elevational view of the cushion formed from yet other modified strips of arch-like segments;

FIG. 13 is a plan view of the cushion formed from a slab of foam material that is slit and shortened to effect strips of arch-like segments;

FIG. 14 is a sectional view taken along line 14—14 of FIG. 13; and

FIG. 15 is a sectional view taken along line 15—15 of FIG. 13.

DETAILED DESCRIPTION

Figure 1:
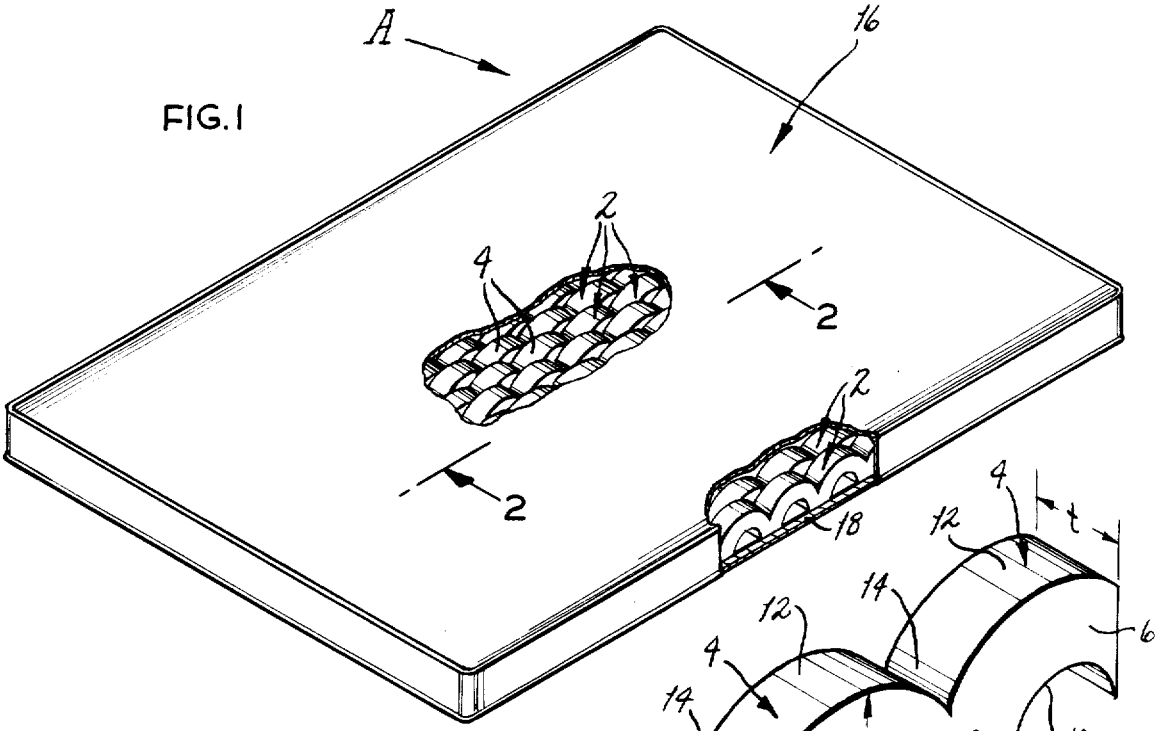
FIG. 1 is a perspective view of a cushion constructed in accordance with the present invention, the cover of the cushion being broken away to expose the foam strips that provide the cushioning characteristics.

Referring now to the drawings, a cushion A (FIG. 1), which takes the form of a mattress, displaces to conform to the contours of the human body, and in so doing exerts a supporting counter pressure on the skin area that is in contact with it. That pressure is generally uniform and its deforming effects on the tissues of the body supported by it are minimal. Thus, even though the hip region may protrude further into the cushion A than the waist region or the thigh region, the pressure exerted on the skin at all of those regions remains essentially the same. The cushion A includes strips 2 of resilient foam which are arranged side-by-side, yet are for all intents and purposes detached from each other. Each of the strips 2 is composed of a succession or row of arch-like segments 4, with each segment 4 in turn having six degrees of freedom, that is it can be displaced to the left or to the right, forwardly or backwardly, and upwardly or downwardly. The strips 2 are held together in any one of several ways that do not prevent their arch-like segments 4 from deflecting individually. While the cushion A described herein is configured to serve as a mattress, obvious alterations in size will render it useful as a seat cushion, or as a back rest, or for any other type of cushioning device in which it is desirable to have generally uniform supporting characteristics.

Each strip 2 is an integral structure that is formed from a resilient material such as expanded polyurethane. It is preferably of uniform thickness t (FIG. 4), having planar side faces 6 that are parallel, although the side faces may converge in one direction or the other if desired. Along these side faces 6 the strip 2 contacts the strips 2 immediately adjacent to it in the cushion A, but preferably the strips 2 are completely detached from each other at their abutting side faces 6. If the strip 2 is connected to the adjacent strip 2 it should be only along the lower margins of the strips 2, with the connection preferably taking the form of a small region of adhesive in the nature of a tack.

Figure 4:
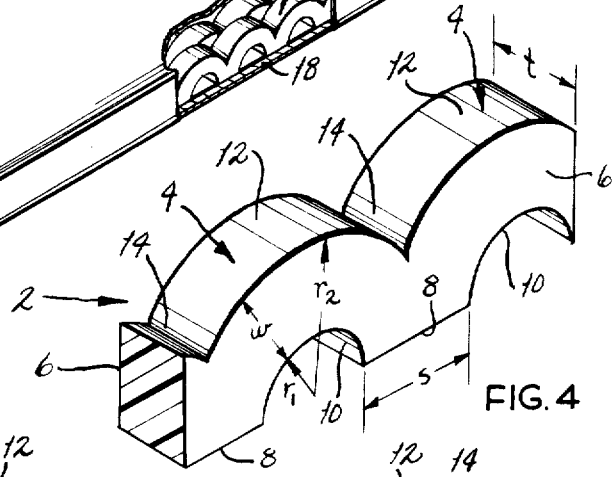
FIG. 4 is a partial fragmentary view of one of the strips in the cushion.

The downwardly presented face of each strip 2, that is its back face, is composed of alternating planar surfaces 8 and concave surfaces 10, and accordingly the surfaces 8 are in effect intermediate surfaces located between the concave surfaces 10. The planar surfaces 8 rest on a subjacent supporting surface which may be a conventional mattress or even a mattress board. Thus, the cushion A is itself supported at its planar surfaces 8. Inasmuch as the planar surfaces 8 extend across the entire thickness of the strip 2, the width of each surface 8 is equal to the thickness t of the strip 2, and the same holds true with respect to concave surfaces 10. The planar surfaces 8 have a length s (FIG. 4). Each concave surface 10 is preferably the arc of a circle having a radius $r_1$. Preferably each concave surface 10 extends 180° between the two planar surfaces 8 at each end of it. Thus, the centers of curvature for the concave surfaces 10 are in the plane of the planar surfaces 8.

The upwardly presented face, that is the front face, of each strip 2 is composed of a succession of convex surfaces 12 which intersect at valleys 14, there being a separate convex surface 12 located immediately beyond each concave surface 10. Thus, the concave and convex surfaces 10 and 12 create the succession of arch-like segments 4 in the strip 2 or in other words a row of arch-like segments 4. Each convex surface 12 extends entirely across the strip 2 and forms the arc of a circle having a radius $r_2$ (FIG. 4), with the center of curvature for that arc being coincident with the center of curvature for the concave surface 10 located immediately inwardly from it. The radius $r_2$ for the convex front surfaces 12 should be greater than radius $r_1$ by a magnitude which depends on the bending properties of the resilient material, to develop the desired counter force for that particular arch-like element 4. The arrangement should be such that concave surfaces 10 rise to slightly less than the elevation of the valleys 14, but the valleys 14, being offset from the concave surfaces 10, do not impair the strength or resiliency of the strip 2. Indeed, the width w of the strip 2 remains relatively constant throughout the length of the strip 2, and that width is the difference between the radii $r_2$ and $r_1$ for the two arcuate surfaces 12 and 8, respectively. Actually, the thickness increases somewhat at the ends of the arcuate surfaces 8, so that the strip 2 has its greatest thickness at the valleys 14.

Since the centers of the arch-like segments 4 project farthest, any load that is applied to the cushion will appear initially at the centers of the convex surfaces 12, and not at the valleys 14. If the load is applied directly downwardly, or more precisely toward the plane of the surfaces 8, as it will in most instances, the arch-like segments 4 which are subjected to the load will yield near the valleys 14 and will cave inwardly toward the plane of the surfaces 8. The arch-like segments 4 yield with a somewhat uniform force and hence the counter pressure applied to the load is generally uniform over the areas in contact with the arch-like segments 4. In other words, once an initial yield or break down point is exceeded, the force required to deflect an arch-like segment 4 remains essentially constant over a relatively large range of deflection, and this characteristic may be illustrated graphically (FIG. 5). If the force imparted by the load is skewed, that is oblique to the plane of the planar surfaces 8, the arch-like segments 4 will likewise yield in the direction of the load, and again this yielding will occur primarily in the regions of the valleys 14. Thus, the arch-like elements 4 may yield laterally in either direction or longitudinally in either direction with a nearly constant force throughout a useful range of travel.

Figure 2:
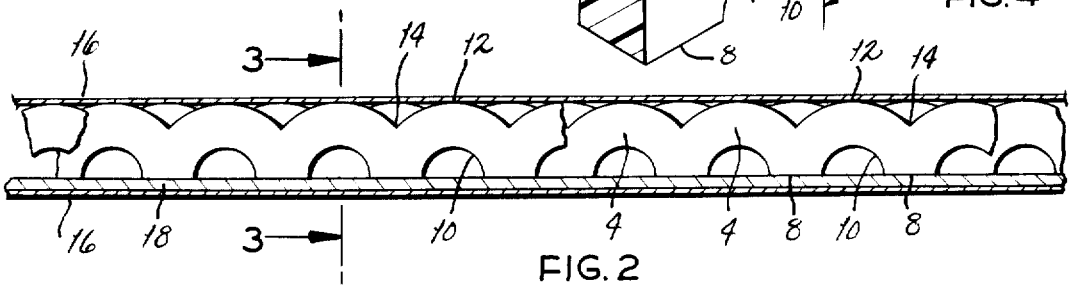
FIG. 2 is a sectional view of the cushion taken along line 2—2 of FIG. 1.
Figure 3:
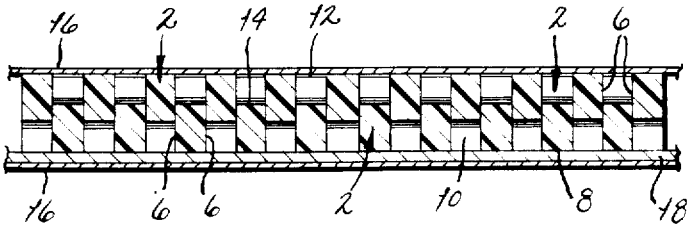
FIG. 3 is a sectional view of the cushion taken along line 3—3 of FIG. 2.

The strips 2, while being positioned side-by-side in the cushion A, are offset such that the voids formed by the concave surfaces 10 in any one strip are located opposite the planar areas 8 of the strips 2 positioned immediately adjacent to it (FIGS. 2 and 3). As a consequence, the voids at the valleys 14 in any strip 2 are located opposite to the sides of the arch-like segments 4 on the adjacent strips 2. In other words, the strips 2 are staggered such that the valleys 14 of any strip 2 are preferably centered with respect to the arch-like segments 4 on the adjacent strips 2, and this places the concave surfaces 10 of the one strip 2 alongside the valleys 14 of the two adjacent strips 2. Thus, one traversing the cushion A, that is moving crosswise over the upper or front face of the cushion A, will encounter alternate convex surfaces 12 and valleys 14 of different strips 2. Similarly, one moving longitudinally along any particular strip 2 will likewise encounter alternate convex surfaces 12 and valleys 14 within the same strip 2.

The offset, however, need not be such that the valleys 14 are centered with respect to the arch-like segments 12, and indeed may be varied as desired by shifting any one strip 2 longitudinally with respect to its adjacent strips 2. Also adjacent strips 2 may have arch-like segments 12 of differing length which would vary the offset between the arch-like segments 2 of adjacent strips 2.

The strips 2 may be held together merely by stretchable cover 16 (FIG. 1) formed from a two-way stretch material, or they may be joined together by an adhesive along their side faces, in which case the cover 16 may not be necessary. However, the adhesive bonds should be of very limited area and should be as close to the planar surfaces 8 as possible, so that one strip 2 does not impede flexure of the strips 2 that are adjacent to it. In other words, adjacent strips 2 should be essentially detached from one another. Also, all of the strips 2 may be adhesively bonded independently of each other to a flat underlying support member 18, in which case the adhesive would be along the planar surfaces 8. The underlying member 18 may be somewhat flexible or rigid. Other types of attachment at the planar surfaces are also suitable. For example, fastening material sold under the trademark Velcro may be used to secure the strips to an underlying member 18.

Since one strip 2 should be free to flex relative to its adjacent strips 2, it is desirable to reduce the friction between adjacent strips 2 as much as possible, particularly when the strips 2 are formed from a polymer foam material which has a relatively high coefficient of friction anyway. This may be achieved by covering the side faces 6 of the strips with a low friction material such as nylon fabric. In other words, the two side faces 6 of each strip 2 have a low friction cloth applied to them such as by an adhesive Then, when one strip 2 is deflected relative to its adjacent strips 2, the side faces 6 on those strips 2 slide easily across one another so that one strip 2 does not impair flexure of the other.

Each strip 2 is preferably formed independently in the undulating configuration from a resilient material having spring-like characteristics. Such materials include polymer foams, nylon and spring metals. The resilient material may also be a composite of two or more polymer foams or a composite of a polymer foam and another material such as nylon or spring metal.

Where the strip 2 is formed from a polymer foam, it may be molded in the undulating configuration or it may be cut from a rectilinear strip of that material. Similarly, the undulating configuration formed by the succession of alternating convex surfaces 12 and valleys 14 may be derived by compressing a rectangular strip of foam material, alternately from one side and then the other, and then slitting the foam material along a planar cut that is centered between the opposite regions where it is compressed. When the forces causing the compressions or flexure are released, the foam material assumes its natural configuration and the planar cut transforms into an undulating surface.

Preferably, the foam is closed cell so that it is impervious to water and body fluids. If the foam is open cell and cast in a mold, it may be cast with a sealed surface, that is a skin.

In a typical cushion A that is suitable for use as a mattress, the following dimensions for the strips 2 are acceptable where the foam is polyurethane having a density of 2 to 3 lbs/ft$^3$:

radius $r_1$ of concave surface 8—2 inches
radius $r_2$ of convex surface 12—5 inches
length s of planar area 8—4 inches
width t of strip 2—2½ inches When it is used as a seat cushion, it should have a somewhat higher density on the order of 10 to 18 lbs/ft$^3$.

If the cover 16 is used over the front faces of the strips 2 of foam material, either to hold those strips 2 together as previously mentioned, or to provide a more uniform supporting surface, the material of the cover 16 should preferably be capable of stretching both longitudinally and transversely or should, in other words, have two-way stretch characteristics.

Whenever, the cushion A is deformed within its useful range, such as by an individual lying or sitting upon it, the supporting pressure exerted by the deformed area will remain relatively constant irrespective of the extent of the deformation. Thus, the cushion A exerts a generally uniform pressure over the skin area that is against it, even though some skin area may be immersed in the cushion A more than others. Moreover, the cushion A is wider than the individual who lies or sits upon it and accordingly some of the strips 2 will remain undeflected to the side of that individual. These strips 2 tend to cradle the individual and prevent him from rolling off the cushion A. To enhance the cradling effect, the side strips 2 may be formed from a foam material that is somewhat less resilient or stiffer than the foam material of the remaining strips 2 that are located closer to the center of the cushion A. By the same token, the radius for the concave surfaces 10 on the outer strips 2 may be decreased to give the outer strips 2 greater body and therefore less resilience, or the outer strips may be merely of block form, that is completely free of arch-like segments 4.

The concave and convex surfaces 10 and 12 need not be arcuate in the sense that they are circular, but instead may possess other curved configurations such as ellipsoidal or parabolic configurations. Moreover, the concave and convex surfaces 10 and 12 of any strip 2 may be of different curved configuration, such as one may be of circular configuration and the other of ellipsoidal configuration. Also, the cushion A, particularly when it is used in narrower configurations, may be composed merely of a single strip 2 which is considerably wider than the strips 2 when used in a staggered arrangement. On the other hand, when formed from multiple strips 2, some of those strips 2 may be inverted such that their planar and concave surfaces 8 and 10 are presented upwardly, while in other strips 2 may be upright in the normal disposition.

The valleys 14 in the forwardly or upwardly presented surfaces of the cushion A provide regions where air can contact the supported body. Moreover, when the valleys 14 are in staggered strips 2, the valleys 14 of one strip 2 may open into the voids delineated by the concave surfaces 8 in an adjacent strip 2 and this enables air to circulate freely through the valleys 14 and adjacent to the portion of the body supported at those areas.

When the strips 2 are not joined to each other or permanently to the base member 18, they may be removed from the cushion A and cleaned individually. Even when they are joined to each other or to the base member 18, the strips 2 still may be cleaned easily with a jet of water because they deflect so readily.

A modified strip 20 (FIGS. 6 & 7) which is suitable for use in the cushion A is likewise formed from resilient material and includes a succession of arch-like segments 22, each having a convex upper surface 24 and a concave lower surface 26. In contrast to the strip 2, the strip 20 also includes a generally flat base 28 that extends along the entire bottom of the strip 20 and, indeed, forms a mount for the strip 20. The arch-like segments 22 and the base 28 possess the same width and are formed integral, the side faces of the segments 22 and base 28 being planar and flush. Each arch-like segment 22, midway between its ends, that is in its region of greatest height has a hole 30 which extends from one planar side face to the other, and in addition a slit 32 which extends from the hole 30 downwardly to the concave lower surface 26. The slit 32 likewise extends from one side face to the other and together with the hole 30 relieves stress in the arch-like segment 22 when it is depressed, thus rendering the segment 22 more flexible than it would otherwise be.

The modified strips 20 are arranged in a cushion much like the strips 2, that is with strips 20 located side-by-side, their bases 28 being against an underlying supporting surface 34. Moreover, the arch-like segments 22 of adjacent strips 20 are offset, and the strips 20 are for all intents and purposes detached from one another at the side faces of the arch-like segments 22 so that the segments 22 depress independently. When deflected, the arch-like segments 22 of the strips 20 exert generally uniform resisting forces, irrespective of whether the deflections are uniform or not.

Like the strips 2, the strips 20 may be die cut from a resilient foam material or they may be molded. They may be formed from other spring-like materials as well.

A modified strip 40 (FIGS. 8 & 9) is very similar to the strip 20, at least in outward appearance, but is formed from a succession of sections 42 which are detached from each other. Each section 42 has a base 44 and two arcuate half segments 46 and 48 which project upwardly from the base 42 and diverge. Whereas each arcuate segment 22 of the strip 20 occupies essentially 180°, each half segment 46 and 48 of the strip 40 each occupies essentially 90°. The sections 42 are arranged end-to-end to form the strip 40, and when so arranged, the ends of the base 44 for any section 42 may abut the ends of the bases 44 on the two adjacent sections 42, while the end of the arcuate half segment 46 for any section 42 abuts the end of arcuate half segment 48 on the adjoining section 42. Similarly, the end of the arcuate half segment 48 abuts the end of the arcuate half segment 46 on the other adjacent section 42. Thus, two sections 42 are required to provide full convex and concave surfaces 50 and 52, those surfaces of course being on the arcuate half sections 46 and 48 of adjacent sections. Each strip 40 is essentially detached from the strips 40 adjacent to it, at least along their half segments 46 and 48 so that the segments 46 and 48 deflect independently. Moreover, the sections 42 of adjacent strips 40 are offset so that full convex and concave surfaces 50 and 52 of one strip 40 do not align with concave and convex surfaces 50 and 52 on adjacent strips 40.

The sections 42 that comprise the strips 40 are preferably formed from a resilient foam material, and may be die cut or injection molded from such material or from nylon. The sections 42, however, are configured such that they may also be formed in an extrusion process. More specifically, the foam or other material is extruded through a die having the configuration of the section 42. Once the foam material has cured, the extrusion is sliced into segments 42 which are thereupon set end to end and fastened at their bases 44 to a suitable supporting surface 54 or the bases 44 of adjacent sections 44 may be joined together, such as by an adhesive, to form a unitized structure.

In use, one sits or lies on the upwardly presented convex surfaces 50 and thereby deflects the arcuate half segments 46 and 48 toward the bases 44 of their respective sections 40. The arcuate half segments 46 exert a generally uniform restoring force, irrespective of the amount of deflection, so that the skin area that is in contact with the cushion formed by the strips 40 bears the supporting force exerted by the cushion in a uniform manner, that is to say the supporting force is distributed generally uniformly over that skin area.

To afford greater deflection in the arcuate half segments 46 and 48, the base 44 of the section 40 may be shortened, in which case adjacent sections abut only at the ends of their arcuate half segments 46 and 48, but not along the ends of their bases 44.

Still another modified strip 60 (FIGS. 10 & 11) possesses a true undulated configuration in that it has a succession of arcuate segments 62 that are arranged alternately in opposite directions. This results in convex surfaces 64 that are presented alternately upwardly and downwardly, and likewise concave surfaces 66 that are located behind the convex surfaces 64 such that the thickness of the strip 60 remains substantially constant between planar side faces. The strips 60 may be cut or stamped from a resilient foam material or they may be formed from some other resilient material.

The strips 60 are arranged side-by-side with adjacent strips 60 preferably detached at their side surfaces so the arcuate segments 62 of any one strip 60 may flex independently of the nearby arcuate segments 62 of the adjacent strips 60. The arrangement is also such that the upwardly presented convex surfaces 64 of any one strip 60 are offset from the upwardly presented convex surfaces 64 of the adjacent strips 60 on each side of it, and of course the same offset holds true with regard to the downwardly presented convex surfaces 64 and the concave surfaces 66. The side-by-side strips 60 are attached to a subjacent support 68, such as a board, along their downwardly presented convex surfaces 64.

When a user rests upon the cushion formed by the undulating strips 60, his or her skin area comes against the upwardly presented convex surfaces 64 on the strips 60 and the arcuate segments deflect. Again the restoring force exerted by the deflected arcuate segments 62 is generally uniform irrespective of the extent of the deflection. Thus, the supporting force exerted by the strips 60 is distributed generally uniformly over the skin area that is in contact with the strips 60.

In lieu of constructing the cushion from truly undulated strips 60, straight strips 70 (FIG. 12) of resilient material may be deformed against the natural resiliency of the material into a somewhat undulated configuration, so as to have arcuate segments 72, the strips 70 being attached to a base 74, such as a board, in that configuration. The points of attachment are offset along adjacent strips 70 so that the arcuate segments 72 of any strip 70 are offset from the arcuate segments 72 of the adjacent strips.

The arcuate segments 72 of the strips 70 are detached from the arcuate segments 72 of adjacent strips 70 and behave much the same as the segments 62 of the strips 60, so that the segments 72 exert generally uniform supporting forces when deflected by a body upon it.

Another modified strip 80 (FIGS. 13–15) or more accurately a succession of strips 80, is formed by slitting a flat slab 82 of foam or other cushioning material. The slits are arranged to be along the strips 80, but adjacent strips 80 do not share a common slit. Instead each slit lies along only one strip 80 with adjacent strips 80 being separated by narrow intervening strips 84. The slits moreover are not continuous along the strips 80 and 84, but instead are interrupted so as to provide anchoring pads 86 along the strips 80 and 84. By urging the ends of the slab 82 together over a supporting surface 88, such as a piece of plywood, the segments of the strips 80 between the anchoring pads 86 bow upwardly, forming arch-like segments 90. The segments 90 are maintained in the arch-like configuration by securing the anchoring pads 86 to the surface 88. The intervening strips 84 also deform, but do not interfere with the load-supporting strips 80. As between adjacent strips 80, the arch-like segments 90 are offset, and so are the anchoring pads 86.

When a load is applied to the strips 80, the arch-like segments 90 deflect and support the load. However, the restoring force exerted by each arch-like segment 90 is generally independent of the amount that it is deflected.

Irrespective of the type of strips that are used in the cushion A, within any strip the arches of that strip may vary in height to provide within the overall cushion A a contoured support surface. For example, in a seat cushion A having the strips 2 the arch-like segments 12 in the region where the user's legs project forwardly from the cushion may be shorter than the other arch-like segments to create two recesses for cradling the user's legs. Also the arch-like segments in the region of the buttocks may likewise be somewhat shorter. The result is a contoured seating surface which is most comfortable over long periods of time.

Being formed from arches, the various strips and the cushions in which they are located may be provided with inactive areas or regions merely by tying down or collapsing arches where no support is desired. This is a simple matter which affords considerable variation to and control over the type of support that is provided.

This invention is intended to cover all changes and modifications of the example of the invention herein chosen for purposes of the disclosure which do not constitute departures from the spirit and scope of the invention.

What is claimed is:

1. A cushion comprising: arch-like segments formed from a resilient material and arranged in a plurality of side-by-side rows such that each row possesses a generally undulated configurastion, each arch-like segment having a curved convex surface and a curved concave surface, as well as generally flat side surfaces between the curved convex and concave surfaces, the arch-like segments of the rows being arranged such that the curved convex surfaces are presented in one direction and the curved concave surface are presented in the opposite direction and further such that side faces of the arch-like segments in adjacent rows face each other and are located in close proximity to each other, the arch-like segments of any one row being offset with respect to the arch-like segments of a row adjacent to that one row so that curved surfaces of the arch-like segments in the two rows do not align.

2. A cushion according to claim 1 wherein the arch-like segments of any one row are substantially detached from the arch-like segments in adjacent rows, so that the arch-like segments will deflect generally independently of each other.

3. A cushion according to claim 2 wherein the arch-like segments have side faces and the side faces for the arch-like segments of one row face the side faces for the arch-like segments of the adjacent row, and wherein the side faces of the arch-like segments are covered with a low friction material.

4. A cushion according to claim 1 wherein the arch-like segments of any one row are joined together in a strip having valleys between the convex surfaces, the strip also having generally flat surfaces between and presented in the same direction as the concave surfaces, with the flat surfaces being located directly beyond the valleys.

5. A cushion according to claim 1 wherein the arch-like segments of each row are joined together in a strip and the strip also includes a base that extends the length of the strip, with the concave surfaces being presented toward the base.

6. A cushion according to claim 5 wherein the arch-like segments have slits which open out of their concave surfaces to render the arch-like segments more pliable.

7. A cushion according to claim 6 wherein each arch-like segment has a hole extended transversely through it intermediate its convex and concave surfaces, and the slit extends from the hole to the concave surface.

8. A cushion according to claim 1 wherein the arch-like segments are composed of sections set end to end, with each section including a base that is against the supporting surface and two arcuate half segments which diverge from the base, one arcuate half segment aligning with an arcuate half segment on an adjacent section of the same row to form an arch and the other arcuate half segment aligning with an arcuate half segment on another adjacent section of the same row to form another arch.

9. A cushion according to claim 1 wherein the arch-like segments are derived from a slab which is slit such that when its ends are moved together the arch-like segments protrude from it.

10. A cushion according to claim 9 wherein successive arch-like segments of any row are joined at anchoring pads which are attached to the supporting surface.

11. A cushion according to claim 10 wherein the anchoring pads are wider than the arch-like segments that they join; and further comprising intervening strips located between the arch-like segments of adjacent rows and being connected to the anchoring pads of the rows between which they are located.

12. A cushion according to claim 1 wherein the resilient material is a polymer foam.

13. A cushion according to claim 1 wherein the arch-like segments in at least some of the rows vary in height to provide a shaped seating surface.

14. A cushion according to claim 1 including a cover formed from a two way stretch material and extending over the rows of arch-like segments to cover those segments on at least one of their curved surfaces.

15. A cushion according to claim 1 wherein the side faces of each arch-like segment are generally planar and parallel.

16. A cushion according to claim 1 wherein the side faces for the arch-like segments along a side of any one row are coplanar.

17. A cushion according to claim 16 wherein the planar side faces of the arch-like segments in any one row are substantially in contact with the planar side faces of the arch-like segments for each row that is adjacent to that one row.

18. A cushion according to claim 16 wherein the planar side faces of the arch-like segments for all of the rows are generally parallel.

19. A cushion comprising a plurality of strips which are located side-by-side and are formed from a resilient foam material, each strip having a front face which is presented toward the user of the cushion and a back face which is presented away from the user of the cushion and generally flat side faces extended between the front and back faces, the front and back faces of the strips being configured to provide a succession of arches along each strip with the arches being oriented to impart a generally undulated shape to each strip, the strips being positioned with the side faces of any one strip being close to and facing the side faces of the strips adjacent to that strip, and with such facing side faces being substantially detached from each other so that the strip does not significantly impede flexure of the strips adjacent to it and vice-versa, the strips also being positioned such that the arches on any one strip are offset with respect to the arches of the strips adjacent to that one strip, so that the arches of adjacent strips do not align across the cushion.

20. A cushion comprising a resilient material having a front face presented toward the user of the cushion and a back face presented away from the user, the resilient material at one of its faces having convex surfaces that come together and form valleys and at its other face having concave surfaces, there being a single concave surface directly behind each convex surface so that any convex surface and the concave surface which corresponds to it form an arch in the resilient material, with the arch having generally flat side faces that extend generally between the concave and convex surfaces, the arches being arranged in rows with side faces of the arches in any row being presented toward and facing the side faces of the arches in the rows adjacent to that row, the side faces of the arches in any one row further being in closed proximity to the side faces of the arches in the rows adjacent to that one row, yet with the side faces of the arches for adjacent rows being generally detached so that the arches of adjacent rows will flex generally independently of each other, the arches in any one row being staggered with respect to the arches in the rows adjacent to that one row, so that the convex surfaces of adjacent rows are offset with respect to each other.

* * * * *

UNITED STATES PATENT AND TRADEMARK OFFICE

CERTIFICATE OF CORRECTION

PATENT NO. : 4,713,854

DATED : December 22, 1987

INVENTOR(S) : Robert H. Graebe

It is certified that error appears in the above-identified patent and that said Letters Patent is hereby corrected as shown below:

Column 9, line 34 cancel "configurastion" and substitute therefor "configuration"

Column 9, line 40 cancel "surface" and substitute therefor "surfaces"

Column 9, line 46 cancel "that" and substitute therefor "the"

Column 12, line 7 cancel "closed" and substitute therefor "close"

Signed and Sealed this

Seventh Day of June, 1988

*Attest:*

*Attesting Officer*

DONALD J. QUIGG

*Commissioner of Patents and Trademarks*